United States Patent [19]

Arrington

[11] Patent Number: 4,815,541

[45] Date of Patent: Mar. 28, 1989

[54] FIRE EXTINGUISHER

[76] Inventor: Richard C. Arrington, 2500 Park Central Blvd., Decatur, Ga. 30035

[21] Appl. No.: 68,117

[22] Filed: Jun. 29, 1987

[51] Int. Cl.[4] ..... A62C 31/02

[52] U.S. Cl. ..... 169/74; 169/75; 169/88; 169/89; 222/402.11; 222/402.13

[58] Field of Search ..... 169/71, 74, 75, 88, 169/89; 222/402.11, 402.13, 402.1

[56] References Cited

U.S. PATENT DOCUMENTS

| | | | |
|---|---|---|---|
| 2,375,615 | 5/1945 | Boal | 169/31 |
| 2,478,052 | 8/1949 | Palm | 285/173 |
| 2,649,919 | 8/1953 | Weaver et al. | 169/31 |
| 2,681,707 | 6/1954 | Mapes | 169/31 |
| 2,727,759 | 12/1955 | Elliott | 284/18 |
| 3,061,014 | 10/1962 | Forrester et al. | 169/31 |
| 3,105,458 | 10/1963 | Downham | 169/75 |
| 3,138,331 | 6/1964 | Kutik | 239/337 |
| 3,283,785 | 11/1966 | Beres et al. | 137/628 |
| 3,530,941 | 9/1970 | Arne et al. | 169/31 |
| 3,583,608 | 6/1971 | Green | 222/402.24 |
| 3,627,263 | 12/1971 | Warren | 251/353 |
| 3,684,185 | 8/1972 | Milcos | 222/402.1 |
| 3,721,300 | 3/1973 | Becker et al. | 169/74 |
| 3,744,682 | 7/1973 | Blank | 222/402 |
| 3,749,286 | 7/1973 | Douglas | 222/402.13 |
| 3,889,856 | 6/1975 | Morane | 222/402 |
| 3,967,760 | 7/1976 | Marcon | 222/153 |
| 4,019,584 | 4/1977 | Allmendinger | 169/74 |
| 4,390,160 | 6/1983 | Reed | 251/149.6 |
| 4,427,134 | 1/1984 | Almouli | 222/402.11 |
| 4,518,103 | 5/1985 | Lim et al. | 222/402.1 |
| 4,619,328 | 10/1986 | Seyler et al. | 169/75 |
| 4,664,300 | 5/1987 | Strickland | 222/402.13 |

FOREIGN PATENT DOCUMENTS

| | | | |
|---|---|---|---|
| 60775 | 3/1975 | Australia | 222/402.1 |

*Primary Examiner*—Sherman D. Basinger
*Assistant Examiner*—Thomas J. Brahan
*Attorney, Agent, or Firm*—Dority & Manning

[57] ABSTRACT

A fire extinguisher actuator for a hand held fire extinguisher is disclosed. The actuator includes a support structure which may be pressed into place about the opening of a pressurizable container having fire extinguishing fluid therein. The support structure is provided with an opening for receiving a nozzle member. The nozzle member is configured for depressing a valve in the opening of the pressurizable container for actuating the valve. The nozzle member defines an intake passage in fluid communication with the opening of the pressurizable container, a restriction passage in communication with the intake passage, and a nozzle passage in communication with the restriction passage. A pushbutton lever is pivotally attached to the support structure and upon depression thereof, forces the nozzle member downward to actuate the valve to release pressurized fluid from the container and into the intake passage of the nozzle member. The pressurized fluid is in a substantially gaseous state upon being introduced into the nozzle member and substantially liquifies as it passes through the restriction passage. Upon exiting the restriction passage, the pressurized fluid substantially gasifies for emission from the nozzle passage in a desirable manner for extinguishing fires.

12 Claims, 2 Drawing Sheets

FIRE EXTINGUISHER

BACKGROUND OF THE INVENTION

The present invention relates generally to a portable fire extinguisher, and more particularly, to an improved push button actuator for actuating a valve to controllably release pressurized contents from a portable fire extinguisher.

Hand held fire extinguishers are well known. Such fire extinguishers have found particular use in environments such as kitchens, automobiles, boats and the like, where small fires are possible. For hand-held fire extinguishers to find maximum effective use, they must be reliable and easy to put in operation quickly. Further, they must be affordable so that consumers will buy them and actually put them into use.

Although hand-held fire extinguishers are well known, the present invention deals specifically with a simplified actuator for releasing pressurized fluid from the fire extinguisher in an effective manner heretofore not available.

U.S. Pat. No. 3,138,331, granted to Kutik, entitled, "Actuator for Pressurized Dispensing Cans", discloses the use of a slidable head which includes internal passages. Upon depression of the slidable head, the internal passages become in communication with the pressurized fluid within the dispensing can to dispense the pressurized fluid outwardly therefrom. U.S. Pat. No. 3,530,941, granted to Arne et al., entitled, "Fire Extinguisher With a Pin Connected Control Head", discloses a fire extinguisher having an axial bore which communicates pressurized fluid to an outwardly flared lateral bore upon actuation of a valve member. U.S. Pat. No. 4,019,584, granted to Allmendinger, entitled, "Fire Extinguisher", discloses a fire extinguisher having a nozzle which includes a passage having an inwardly tapered portion terminating adjacent an outwardly flared portion through which pressurized fluid passes upon actuation of a valve stem.

Other devices have been patented for actuation of aerosol containers. U.S. Pat. Nos. 3,744,682, granted to Blank, 3,889,856, granted to Morane, and 3,967,760, granted to Marcon all disclose valve actuators having passages which receive pressurized fluid in a vertical direction from a pressurized container and deliver the pressurized fluid in a horizontal direction.

Problems with the prior fire extinguisher actuators include their relative complexity and cost. Also, problems exist with the inability of prior fire extinguishers to maximize the effectiveness of the application of the pressurized fluid within the fire extinguisher to a fire.

SUMMARY OF THE INVENTION

The present invention recognizes and addresses such drawbacks of the prior fire extinguisher actuators. Hence, it is a general object of this invention to provide a simple fire extinguisher actuator which maximizes the effectiveness of application to a fire of a pressurized fluid released from a fire extinguisher.

It is another object of the present invention to provide a fire extinguisher actuator which is readily attachable to a container carrying pressurized fluid.

It is yet another object of the present invention to provide a fire extinguisher actuator of simple design which provides for reliable, reusable operation of a fire extinguisher.

Still another object of the present invention is to provide a fire extinguisher which can be easily operated with one hand.

Various combinations of the presently disclosed features may be provided in a given embodiment thereof in accordance with this invention. Generally, one such exemplary embodiment of the present invention includes a fire extinguisher comprising a pressurizable container having a substantially liquefied pressurized fluid therein. The container has a container opening in fluid communication with the pressurized fluid. The container opening has a circumferential bead extending therearound and a valve situated therein for allowing upon actuation thereof for the pressurized fluid to be released from the container through the container opening, with the pressurized fluid becoming substantially gaseous upon being released through the valve.

A nozzle member is included which is configured for depressing the valve for actuating the valve. The nozzle member defines an intake passage having an intake passage flow area and an intake passage inlet in fluid communication with the valve of the container. The intake passage inlet is for receiving the gaseous pressurized fluid released from the container through the valve upon actuation thereof. The nozzle member also defines a restriction passage in communication with the intake passage. The restriction passage has a restriction passage flow area of substantially smaller area than the intake passage flow area. The restriction passage is configured for receiving the gaseous pressurized fluid from the intake passage and for causing the gaseous pressurized fluid to substantially liquefy during passage therethrough. The nozzle member defines a nozzle passage communicating with the restriction passage for receiving the substantially liquefied pressurized fluid from the restriction passage. The nozzle passage has a nozzle passage flow area of substantially larger area than the restriction passage flow area. The nozzle passage is configured for causing the substantially liquefied pressurized fluid to substantially gasify for emission from the nozzle passage of the nozzle member during application of the gaseous pressurized fluid to a fire, for extinguishment thereof.

A support structure is provided which is received about the container opening. The support structure defines a substantially central opening in communication with the container opening. A plurality of semi-circular attachment members are attached to the support structure and are spaced about the central opening. The semi-circular attachment members have peripheral ridge portions adapted for engaging the circumferential bead adjacent the container opening. A plurality of semi-circular walls are attached to the support structure opposite the semi-circular attachment members for engaging the circumferential bead opposite the container opening. The semi-circular attachment members and semi-circular walls retain the support structure to the container through engagement with the circumferential bead.

A pushbutton lever is provided which is pivotally attached to the support structure and movable between a raised position and a lowered position. The pushbutton lever is contactable with the nozzle member when in the lowered position for forcing the nozzle member downwardly to actuate the valve of the container.

Further, a pull pin is provided having an insertion member for insertion in the support structure beneath the pushbutton lever when the pushbutton lever is in the raised position. The insertion member prevents the pushbutton lever from being moved to the lowered position when inserted therebeneath. The pull pin has an opening adapted for grasping and removing it from beneath the pushbutton lever.

BRIEF DESCRIPTION OF THE DRAWINGS

The foregoing as well as other objects of the present invention will be more apparent from the following detailed description of a preferred embodiment of the invention, including the best mode thereof, when taken together with the accompanying drawings, in which.

DESCRIPTION OF THE PREFERRED EMBODIMENT

Figure 1:
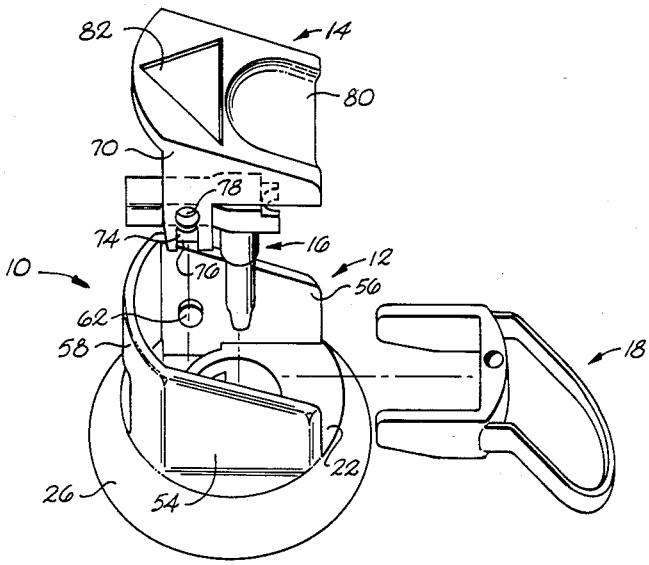
FIG. 1 is an exploded view of a fire extinguisher actuator constructed in accordance with the present invention.

Referring to the drawings in detail, wherein like reference characters represent like elements and/or features throughout the various views, a preferred embodiment of the fire extinguisher actuator of the present invention is designated generally in FIG. 1 by the reference character 10. Fire extinguisher actuator 10 includes a support structure or cap, generally 12, a pushbutton lever, generally 14, a nozzle member, generally 16, and a pull pin, generally 18.

Figure 2:
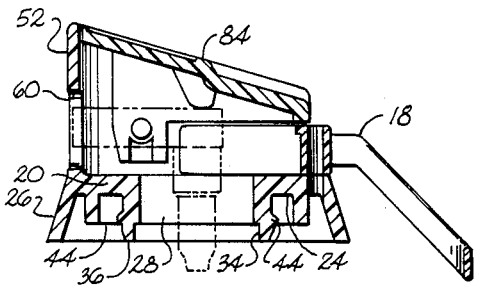
FIG. 2 is a sectional view of the fire extinguisher actuator as illustrated in FIG. 1, with the pushbutton lever shown in the raised position.
Figure 3:
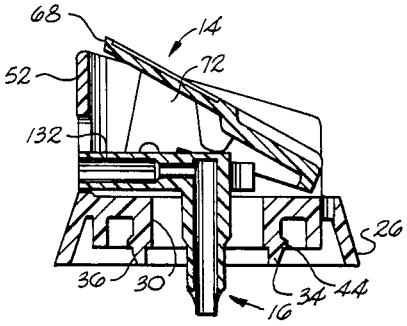
FIG. 3 is a sectional view of the fire extinguisher actuator as illustrated in FIG. 1, with the pushbutton lever shown in the lowered position.
Figure 4:
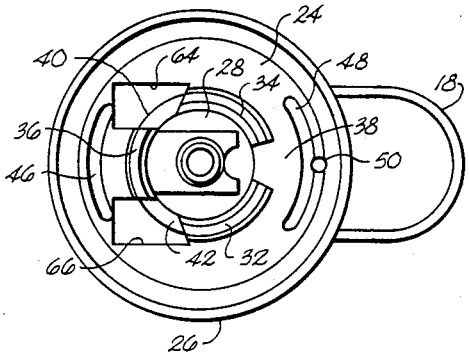
FIG. 4 is a bottom view of the fire extinguisher actuator constructed in accordance with the present invention.

Cap 12 includes a central body portion 20 having a substantially planar upper and lower surfaces 22, 24. Central body portion 20 is generally circular and includes an outwardly flared skirt 26 extending downwardly from the periphery thereof. Central body portion 20 defines a substantially circular central opening 28 bordered by central opening surface 30. Extending downwardly from lower surface 24 of central body portion 20 are semi-circular attachment members 32, 34, and 36, as shown in FIG. 4. Semi-circular attachment member 36 is of shorter length than semi-circular attachment members 32, 34, which are of substantially equal length. Semi-circular attachment members 32, 34, 36 are spaced substantially equidistantly about central opening 28 and share a center of curvature with central opening 28. V-shaped openings 38, 40, and 42 are provided between semicircular attachment members 32, 34, 36, respectively. As shown in FIGS. 2 and 3, peripheral ridge portions 44 are provided on semi-circular attachment members 32, 34, 36 and project outwardly therefrom.

Also extending downwardly from lower surface 24 of body portion 20 are semi-circular walls 46, 48 which have substantially the same center of curvature as do semi-circular attachment members 32, 34, 36 and central opening 28. Semi-circular wall 46 is of slightly less length than semi-circular wall 48. Defined in central body portion 20 adjacent semi-circular wall 48 is a strap attachment opening 50 adapted for receiving a strap (not shown) which may be used to retain pull pin 18 to cap 12.

Extending upwardly from central body portion 20 is a housing 52 having substantially planar walls 54, 56 and a curved wall 58 having substantially the same center of curvature as does central opening 28. A nozzle member opening 60 is defined in a lower portion of curved wall 58. Extending outwardly from an inner surface of each planar wall 54, 56 is a pivot post 62. Also defined in central body portion 20 are voids 64, 66.

Pushbutton lever 14 includes a body member 68 having two legs 70, 72 extending downwardly therefrom. Legs 70, 72 each define a receiving channel 74 which is inclined outwardly from an inner lower edge 76 of each leg 70, 72. Each receiving channel 74 terminates in a pivot post receiving opening 78. Body member 68 of pushbutton lever 14 includes a depression 80 for receiving the finger of a user to allow the user to push downwardly on pushbutton lever 14. An indented triangle 82 is defined on an upper surface 84 of body member 68 to indicate the direction which nozzle member 16 may emit pressurized fluid.

Pushbutton lever 14 is attached to cap 12 by pressing pushbutton lever 14 downwardly within housing 52 of cap 12 such that receiving channels 74 receive pivot posts 62. Pushbutton lever 14 is pressed downwardly until pivot posts 62 are securely received within pivot post receiving openings 78. Engagement of pivot posts 62 with pivot post receiving openings 78 securely retains pushbutton lever 14 to cap 12 and also allows pushbutton lever 14 to be pivoted about pivot posts 62 between a raised position, as shown in FIG. 2, and a lowered position, as shown in FIG. 3.

Figure 5:
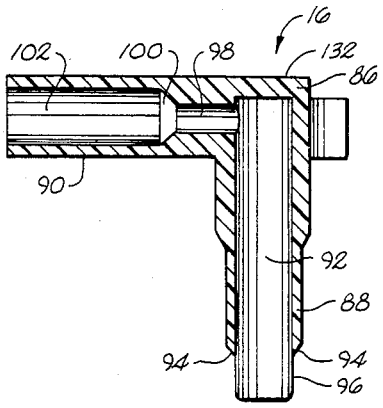
FIG. 5 is an enlarged sectional view of a nozzle member for a fire extinguisher actuator constructed in accordance with the present invention.

Nozzle member 16 includes, as illustrated in FIG. 5, a generally L-shaped body member 86 having a vertical conduit 88 and a horizontal conduit 90. Vertical conduit 88 includes an intake passage 92 which is substantially cylindrical in shape. Two intake passage inlets 94 of substantially inverted, cut-out U-shape are defined in the lower end 96 of vertical conduit 88 and are in fluid communication with intake passage 92. Intake passage inlets 94 are configured to admit pressurized fluid in a turbulent flow state into intake passage 92.

Intake passage 92 communicates with a restriction passage 98 defined in horizontal conduit 90. Adjacent restriction passage 98 and communicating therewith is a transitional passage 100 which is flared outwardly from restriction passage 98. Restriction passage 98 terminates into an adjacent transitional passage 100. Nozzle passage 102 communicates directly with the atmosphere.

Figure 6:
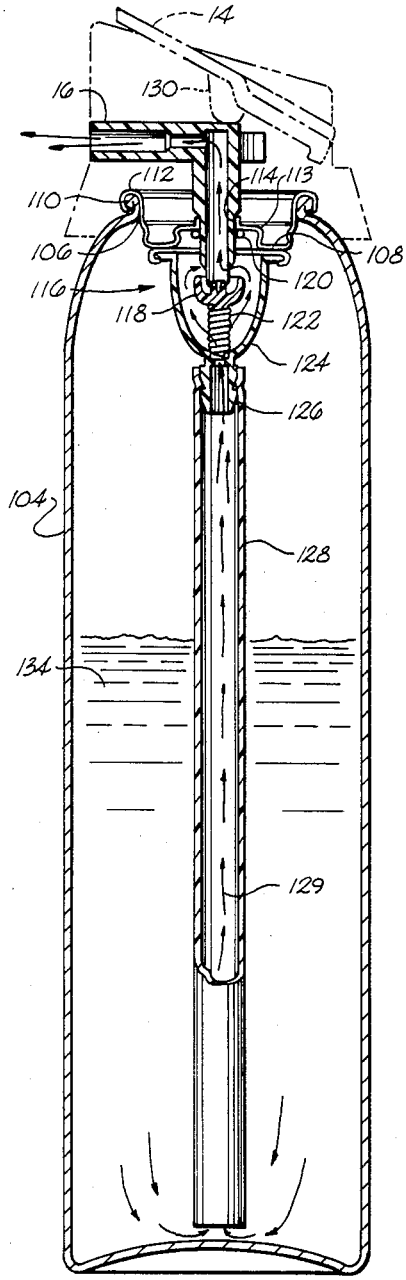
FIG. 6 is a sectional view of a fire extinguisher provided with a fire extinguisher actuator constructed in accordance with the present invention.

As illustrated in FIG. 6, fire extinguisher actuator 10 is attached to a pressurizable container 104. Pressurizable container 104 has a container opening 106 in one end thereof. Container opening 106 is partially covered by a seal member 108. The periphery of seal member 108 is roled downwardly for contacting a rim 110 of pressurizable container 104 to form a circumferentially extending bead 112. Seal member 108 has a protrusion 113 having an opening 114 in which vertical conduit 88 of nozzle member 16 is insertable.

Disposed within pressurizable container below seal member 108 is a valve, generally 116. Valve 116 is of a conventional design and includes a valve element 118 which is normally biased upwards against an O-ring 120 into protrusion 13 by a spring 122, which causes pressurizable container 104 to be normally sealed. A valve chamber 124 surrounds valve element 118 and spring 122 and includes a downwardly extending extension portion 126 to which a dip tube 128 is attached. Dip tube 128 is shown empty for illustrative purposes to allow the flow path therethrough and through valve 116 and actuator 10 to be clearly shown by arrows 129.

In attaching fire extinguisher actuator 10 to pressurizable container 104, cap 12 is simply forced downwardly about the top of pressurizable container 104 such that peripheral ridge portions 44 of semi-circular attachment members 32, 34, 36 engage an inner surface of circumferentially extending bead 112, and so that semi-circular walls 46, 48 engage an outer surface of circumferentially extending bead 112. At this time, a circumferential recess 129 defined on semi-circular attachment members 32, 34, 36 seats with an outer surface of protrusion 113 of seal member 108. The particular configuration of semi-circular attachment members 32, 34, 36 and semi-circular walls 46, 48 allows snug engagement thereof with circumferentially extending bead 112 such that cap 12 is securely fixed to pressurizable container 104. The feature whereby cap 12 may be forced downward to fix it to container allows for a simple construction of the fire extinguisher and also for higher production rates.

After attachment of cap 12 to pressurizable container 104, vertical conduit 88 of nozzle member 16 is inserted through central opening 28 of cap 12 and through opening 114 of seal member 108 such that lower end 96 of nozzle member 16 contacts valve element 118 of valve 116. Horizontal conduit 90 of nozzle member 16 is positioned such that nozzle passage 102 is in communication with nozzle member opening 60 of cap 12. Pushbutton lever 14 is then attached to cap 12 as discussed above such that pivot post receiving openings 78 of pushbutton lever 14 receive pivot posts 62 of cap 12.

In operation of fire extinguisher actuator 10, pushbutton lever 14 is pushed downwardly with one or more fingers from a raised position as illustrated in FIG. 2 to a lowered position as illustrated in FIG. 3. In the lowered position, a curved projection 130 provided on an underside of body member 68 of pushbutton lever 14 contacts an upper surface 132 of horizontal conduit 98 of nozzle member 16. The contact of curved projection 130 with upper surface 132 of nozzle member 16 forces nozzle member 16 downwardly. The forcing downward of nozzle member 14 causes lower end 96 of nozzle member 16 to depress valve element 118. The depression of valve element 118 breaks the sealing of pressurizable container 104 and allows for a pressurized liquid fire extinguisher fluid 134 to pass upwardly through dip tube 28 and into valve chamber 124. Upon passage of fire extinguisher fluid 134 into valve chamber 124, fire extinguishing fluid 134 expands to become substantially gasified and enters intake passage inlets 94 in a turbulent flow state. The substantially gasified fire extinguishing fluid 134 flows upwards through intake passage 92 into restriction passage 98. Restriction passage 98 is configured such that the substantially gasified fire extinguishing fluid 134 substantially liquefies within restriction passage 98. The substantially liquefied fire extinguishing fluid 134 passes from restriction passage 98 into transitional passage 100, where the substantially liquified fire extinguishing fluid 134 expands to become substantially gasified again. The substantially gasified fire extinguishing fluid 134 then passes through nozzle passage 102 and into the atmosphere for extinguishing a fire.

EXAMPLE

The preferred internal configuration of nozzle member 16 allows for a stream of substantially gasified pressurized fire extinguishing fluid 134 to be emitted from cap 12 with such force and in such a tight spray pattern as to enable an approximately 400 gram mixture of HALON (trademark) gas, a halogenated hydrocarbon such as manufactured by DuPont Corporation of Wilmington, Delaware, to extinguish a "Class 2-BC" fire. This is an accomplishment heretofore generally not available with such a small amount of HALON in an economical hand held fire extinguisher. The Class 2-BC rating is given by Underwriters Laboratory Incorporated.

A nozzle member 16 having the following dimensions has been found to yield efficient results:

Diameter of Intake Passage 92 0.199 inches
Length of Intake Passage 92 0.987 inches
Width of Intake Passage Inlets 94 0.125 inches
Height of Intake Passage Inlets 94 0.125 inches
Diameter of Restriction Passage 98 0.120 inches
Length of Restriction Passage 98 0.430 inches
Length of Transition Passage 100 0.0395 inches
Diameter of Nozzle Passage 102 0.199 inches
Length of Nozzle Passage 102 0.500 inches A mixture of HALON gases has been found to be particularly effective in combination with nozzle member 16. The mixture is approximately 70% HALON 1211 and approximately 30% of HALON 1301 gas. The preferred pressure of a gas within pressurizable container is 100 pounds per square inch gage.

Valve 116 is of conventional construction and is of the type manufactured by Bestpak, Inc. of Cary, N.C.

The preferred embodiment of the fire extinguisher of the present invention is small enough to be operated with one hand and to be carried in an automobile or boat glove compartment, travel case, or the like. A fire extinguisher sized as such adds further to the versatility thereof.

It is to be noted that the actuator of the present invention is not limited to use on fire extinguishers. The instant actuator could be used on a variety of different types of pressurizable containers, such as pressurized containers for spraying paint, insecticide, cleaning fluids, etc.

While one preferred embodiment of the invention has been described using specific terms, such description is for present illustrative purposes only, and it is to be understood that changes and variations to such embodiment, including but not limited to the substitution of equivalent features or parts, and the reversal of various features thereof, may be practiced by those of ordinary skill in the art without departing from the spirit or scope of the following claims.

What is claimed is:

1. A fire extinguisher, comprising:

a pressurizable container having a substantially liquefied pressurized fluid therein; said container having a container opening in fluid communication with said pressurized fluid, said container opening having a circumferential bead extending therearound and a valve situated therein for allowing upon actuation thereof for said pressurized fluid to be released from said container through said container opening, said valve configured for causing said pressurized fluid to become substantially gaseous upon being released through said valve;

a nozzle member configured for depressing said valve for actuating said valve, said nozzle member defining an intake passage having an intake passage flow area and a first passage inlet in fluid communication with said valve of said container, said intake passage inlet being for receiving said gaseous pressurized fluid released from said container through said valve upon actuation thereof;

said nozzle member defining a restriction passage in communication with said intake passage, said restriction passage having a restriction passage flow area of substantially smaller area than said intake passage flow area, said restriction passage being configured for receiving said gaseous pressurized fluid from said intake passage and for causing said gaseous pressurized fluid to substantially liquify during passage therethrough;

said nozzle member defining a nozzle passage communicating with said restriction passage for receiving said substantially liquefied pressurized fluid from said restriction passage, said nozzle passage having a nozzle passage flow area of substantially larger area than said restriction passage flow area, said nozzle passage being configured for causing said substantially liquefied pressurized fluid to substantially gasify for emission from said nozzle passage of said nozzle member for application to a fire for extinguishment thereof;

a support structure received about said container opening, said support structure defining a substantially circular central opening in communication with said container opening; a plurality of semi-circular attachment members attached to said support structure and spaced about said central opening, said semi-circular attachment members having peripheral ridge portions adapted for engaging said circumferential bead adjacent said container opening; a plurality of semi-circular walls attached to said support structure opposite said semi-circular attachment members for engaging said circumferential bead opposite said container opening, said semi-circular attachment members and said semi-circular walls being configured for retaining said support structure to said container through engagement with said circumferential bead;

a pushbutton lever pivotally attached to said support structure and movable between a raised position and a lowered position, said pushbutton lever being contactable with said nozzle member when in said lowered position for forcing said nozzle member downwardly to actuate said valve of said container; and a pull pin having an insertion member for insertion in said support structure beneath said pushbutton lever when said pushbutton lever is in said raised position, said insertion member preventing said pushbutton lever from being moved to said lowered positioned when inserted therebeneath; said pull pin having an opening adapted for grasping and removing same from beneath said pushbutton lever when actuation of the fire extinguisher is desired.

2. A fire extinguisher as defined in claim 1, wherein said intake passage is substantially cylindrical, said restriction passage is substantially cylindrical, and said nozzle passage is substantially cylindrical.

3. A fire extinguisher as defined in claim 2, wherein said nozzle member defines a transitional passage connecting said restriction passage and said nozzle passage for allowing fluid communication therebetween, said transitional passage flaring outwardly from said restriction passage into said nozzle passage.

4. A fire extinguisher as defined in claim 2, wherein said intake passage is approximately 0.987 inches in length and approximately 0.199 inches in diameter, said restriction passage is approximately 0.219 inches in length and approximately 0.120 inches in diameter, and said nozzle passage is approximately 0.500 inches in length and approximately 0.199 inches in diameter.

5. A fire extinguisher as defined in claim 1, wherein said nozzle passage and said restriction passage are substantially co-axial with respect to one another, and wherein said intake passage is disposed substantially perpendicularly to both said restriction passage and said nozzle passage.

6. An actuator for a fire extinguisher, the fire extinguisher being of the type having a container for carrying a substantially liquefied pressurized fluid, the container having a container opening in fluid communication with the pressurized fluid, the container opening having a circumferential bead extending therearound, and the container having a valve situated substantially therein for allowing upon actuation thereof the pressurized fluid to be released from the container through the container opening, the pressurized fluid becoming substantially gaseous upon being released through the valve, the actuator being adapted for actuating the valve and comprising;

a nozzle member adapted for partly residing in the container, and extended outwardly therefrom through the container opening, and configured for selectively depressing the valve for actuating same, said nozzle member defining an intake passage having an intake passage flow area and intake passage inlet in contact and fluid communication with the valve of the container thereinside, and intake passage inlet being adapted for receiving the gaseous pressurized fluid released from the container through the valve upon actuation thereof by said nozzle member;

said nozzle member further defining a restriction passage in communication with said intake passage, said restriction passage having a restriction passage flow area of substantially smaller area than said intake passage flow area, said restriction passage being configured for receiving the gaseous pressurized fluid from said intake passage and for causing said gaseous pressurized fluid to substantially liquefy during passage therethrough;

said nozzle member further defining a nozzle passage communicating with said restriction passage for receiving said substantially liquefied pressurized fluid from said restriction passage, said nozzle passage having a nozzle passage flow area of substantially larger area than said restriction passage flow area, said nozzle passage being configured for causing said substantially liquefied pressurized fluid to substantially gasify for emission from said nozzle passage of said nozzle member for application to a fire for extinguishment thereof; and means for attaching said nozzle member to the container and for allowing said nozzle member to be depressed in an axial direction of said intake passage thereof for actuating the valve of the container with axial movement of said intake passage inlet against the valve.

7. An actuator as defined in claim 6, wherein said intake passage is substantially cylindrical, said restriction passage is substantially cylindrical, and said nozzle passage is substantially cylindrical.

8. An actuator as defined in claim 6, wherein said nozzle passage and said restriction passage are substantially co-axial with respect to one another, and wherein said intake passage is disposed substantially perpendicular to both said restriction passage and said nozzle passage.

9. An actuator as defined in claim 6, wherein said nozzle member defines a transitional passage between said restriction passage and said nozzle passage for allowing fluid communication therebetween, said transitional passage flaring outwardly from said restriction passage into said nozzle passage.

10. An actuator for a fire extinguisher, the fire extinguisher being of the type having a container for carrying a substantially liquefied pressurized fluid, the container having a container opening in fluid communication with the pressurized fluid, the container opening having a circumferential bead extending therearound and a valve situated therein for allowing upon actuation thereof for the pressurized fluid to be released from the container through the container opening, the pressurized fluid becoming substantially gaseous upon being released through the valve, the actuator being adapted for actuating the valve and comprising:

a nozzle member for depressing the valve for actuating the valve, said nozzle member defining an intake passage having an intake passage flow area in fluid communication with the valve of the container, said intake passage being for receiving the gaseous pressurized fluid released from the container through the valve upon actuation thereof by said nozzle member;

said nozzle member defining a restriction passage in communication with said intake passage, said restriction passage having a restriction passage flow area of substantially smaller area than said intake passage flow area, said restriction passage being configured for receiving the gaseous pressurized fluid from said intake passage and for causing said gaseous pressurized fluid to substantially liquefy during passage therethrough;

said nozzle member defining a nozzle passage communicating with said restriction passage for receiving said substantially liquefied pressurized fluid from said restriction passage, said nozzle passage having a nozzle passage flow area of substantially larger area than said restriction passage flow area, said nozzle passage being configured for causing said substantially liquefied pressurized fluid to substantially gasify for emission from said nozzle passage for application to a fire for extinguishment thereof;

a support structure received about the container opening, said support structure defining a central opening in communication with the container opening; a plurality of attachment members attached to said support structure and spaced about said central opening, said attachment members having peripheral ridge portions adapted for engaging the circumferential bead adjacent the container opening; a plurality of walls attached to said support structure opposite said attachment members for engaging the circumferential ridge opposite the container opening, said attachment members and said walls retaining said support structure to the container through engagement with the circumferential bead;

a pushbutton lever pivotally attached to said support structure and movable between a raised position and a lowered position, said pushbutton lever being contactable with said nozzle member when in said lowered position for forcing said nozzle member downwardly to actuate the valve of the container; and a pull pin having an insertion member for insertion in said support structure beneath said pushbutton lever when said pushbutton lever is in said raised position, said insertion member preventing said pushbutton lever from being moved to said lowered position when inserted therebeneath; said pull pin having an opening adapted for grasping and removing same from beneath said pushbutton lever to allow said pushbutton lever to be moved to said lowered position for actuating the valve when actuation of the fire extinguisher is desired.

11. An actuator as defined in claim 10, wherein said attachment members and said wall members are semicircular in shape, each having a center of curvature approximately the same as that of the circumferential bead.

12. An actuator as defined in claim 10, wherein said nozzle member further comprises means for introducing substantially gasified pressurized fluid in a generally turbulent flow state into said intake passage.

* * * * *